United States Patent [19]

Webb et al.

[11] 4,085,679

[45] Apr. 25, 1978

[54] FUZE FOR EXPLOSIVE MAGNETOHYDRODYNAMIC GENERATOR

[75] Inventors: George Webb, Richmond; Keith D. Burgess, Rushville, both of Ind.

[73] Assignee: The United States of America as represented by the Secretary of the Air Force, Washington, D.C.

[21] Appl. No.: 753,960

[22] Filed: Dec. 23, 1976

[51] Int. Cl.[2] ..... F42C 15/34

[52] U.S. Cl. ..... 102/70 R; 102/76 P; 102/86.2; 310/11

[58] Field of Search ..... 102/70 R, 76 P, 86.2; 310/10, 11

[56] References Cited

U.S. PATENT DOCUMENTS

| | | | |
|---|---|---|---|
| 2,889,778 | 6/1959 | Bennett | 102/86.2 |
| 2,951,444 | 9/1960 | Hunt et al. | 102/86.2 X |
| 3,449,600 | 6/1969 | Holzman et al. | 310/11 |
| 3,508,086 | 4/1970 | Allport et al. | 310/11 |
| 3,878,409 | 4/1975 | Gill et al. | 310/11 |

*Primary Examiner*—David H. Brown
*Attorney, Agent, or Firm*—Joseph E. Rusz; Willard R. Matthews, Jr.

[57] ABSTRACT

Apparatus by which high explosive charges are propelled into and detonated at the center of an MHD-X generator. The high explosive charge units are engaged and propelled by a reciprocating ram device. Detonating in each instance is achieved by striking with a firing pin a detonator charge that is in register with a booster charge, the booster charge being in detonating communication with the high explosive charge. Various safety requirements are satisfied by a spring loaded slider operating in a channel transverse and adjacent to the booster charge. The slide retains the detonator charge out of register with the booster charge until a safety pin that holds the slider in place is pulled by a lanyard attached between the reciprocating ram and the safety pin. Removal of the safety pin permits the detonator charge to slide into alignment with the booster charge. Firing pin actuation is initiated by the slider at the instant the detonator charge and the booster charge come into register.

2 Claims, 6 Drawing Figures

FUZE FOR EXPLOSIVE MAGNETOHYDRODYNAMIC GENERATOR

STATEMENT OF GOVERNMENT INTEREST

The invention described herein may be manufactured and used by or for the Government for governmental purposes without the payment of any royalty thereon.

BACKGROUND OF THE INVENTION

This invention relates to explosive magnetohydrodynamic generators, and in particular to a safe means for delivering high explosive charges to the center of such devices.

The operation of an explosive MHD-X generator requires the detonation of relatively large explosive charges (about 4 pounds of C-4 explosive) in a spherical explosion chamber. The charges must be detonated in rapid succession (characteristically 5 per second) in the exact center of the spherical chamber.

The explosive round used in an MHD-X generator requires a fuze to initiate the high explosive at the desired time. The interface between the round and the MHD-X is a ram that engages the fuze as the round is accelerated into the firing chamber.

Safety wise, the fuze must provide detonator safety, safe handling, safe loading, and safe operation. The operation of the fuze must assure function of the round at the correct distance from the ram and functioning of the round must be assured to prevent the simultaneous discharge of more than one charge which would overload the system.

The present invention is directed toward providing fuzing apparatus that is safe and reliable and that meets the various operational requirements of MHD-X generators and other devices of that type.

SUMMARY OF THE INVENTION

The present invention comprises a fuze for the type of high explosive charge used in MHD-X. The charge is projected into a spherical explosion chamber and detonated precisely in its center. The fuze provides detonator safety with a slider type safe and arm mechanism. The safety lock can be a safety wire that is sheared and removed by the ram adaptor as it projects the charge into the explosion chamber or a screw that is removed by the operator in the loading process. Correct location of the detonation is assured with a lanyard that releases the spring loaded slider which, in turn, actuates the firing pin as the detonator comes in line with the booster. The firing pin can be cam or lever operated.

It is a principal object of the invention to provide new and improved apparatus for fuzing the high explosive charges used in magnetohydrodynamic explosion generators.

It is another object of the invention to provide a fuze for an MHD-X generator that provides for detonation safety, safe handling, safe loading and safe operation of the high explosive charge being delivered.

These, together with other objects, features and advantages of the invention, will become more readily apparent from the following detailed description when taken in conjunction with the accompanying drawings in which like elements are given like reference numerals throughout.

DETAILED DESCRIPTION OF THE PREFERRED EMBODIMENTS

Figure 1:
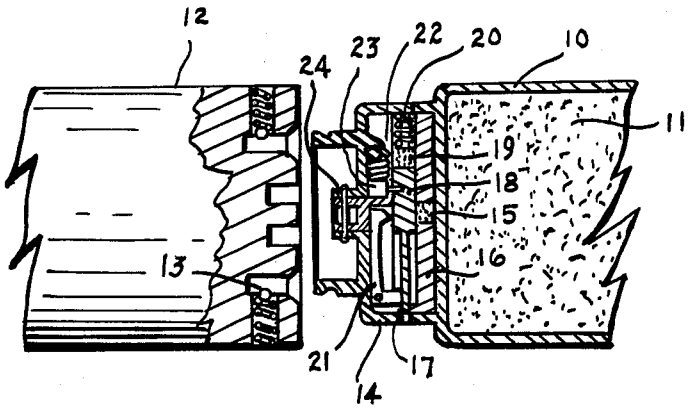
FIG. 1 is a sectional view of one embodiment of the invention showing the apparatus arrangement during an initial stage of device operation.
Figure 2:
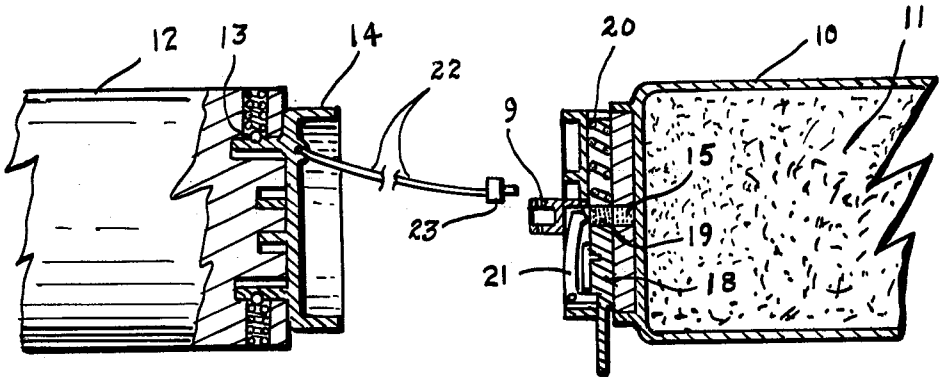
FIG. 2 is a sectional view of the embodiment of FIG. 1 showing the apparatus arrangement during a final stage of device operation.

One presently preferred embodiment of the invention is illustrated by FIGS. 1 and 2 of the drawings. Having reference thereto a high power explosive charge 11 is contained in container 10. A slide housing 16 is affixed to one end thereof together with a firing pin housing 9 that defines a channel 17 within which slide 18 resides. Slider housing 16 also encloses booster charge 15 which is in detonating communication with explosive charge 11. Detonation charge 19 also resides in channel 17 and is held in place out of alignment with booster charge 15 by slider 18 and compressed spring 20. A safety pin 23 keeps slide 18 in place as long as release housing 14 is engaged with slider housing 16. A lanyard 22 connects safety pin 23 with release housing 14. Firing pin 21 is maintained in a nonstriking position by slide 18 as long as release housing 14 and safety pin 23 are in place. A safety wire 24 connects release housing 14 to firing pin housing 9. The entire assembly is picked up and ejected by means of reciprocating ram 12. Ram 12 has spring pressured ball plungers 13 that grip release housing 14. The face plate of ram 12 is configured to sever safety wire 24 when the explosive charge unit is acquired.

The safety requirements as delineated above are met in the following manner. Detonator safety is assured by placing the detonator 19 and slider 18 in channel 17. The slider and detonator are held in the safe position by safety pin 23 and a release housing that blocks a projection on the end of the spring loaded slider. The slider in turn holds the detonator out-of-line to the booster when in the safe position. Thus, accidental detonation of the detonator will not cause a detonation of the round. Accidental arming of the fuze is prevented by the spring loaded safety wire 24 that pins the release housing 14 to the firing pin housing 9 which in turn retains the safety pin in the slider. This release housing thus prevents motion of the spring loaded slider from safe to arm position.

With reference to FIG. 1, operation of the fuze is as follows. The ball plungers 13 in the ram 12 engage the fuze end of the round as it strips the round from the magazine. The inertial resistance of the round will cause a dynamic load that shears the safety wire 24 at the time as it overcomes the ball plungers. When the dynamic loading starts to drop off, an arm spring will remove the safety wire from the release housing 14 and firing pin housing, thereby freeing these housings. When the ram reaches the end of its stroke, the release housing is retained by the ram (ball plunger detent action) as the round is projected into the firing chamber. This projection of the round will deploy lanyard 22 that is attached to the release housing 14 and the safety pin 23. When the lanyard is fully deployed, the safety pin is withdrawn to release the spring loaded slider 18 that hits the firing pin 21. The firing pin will rotate to cause the point to hit the detonator 19 as it comes in line with the booster 15. This action results in detonation of the round at the correct location in the firing chamber. FIG. 2 shows the round as the firing pin hits the detonator. As the ram is withdrawn to prepare for the injection of the next charge, the release housing is stripped from the ram adapter by a conventional extractor mechanism (not shown).

Figure 3:
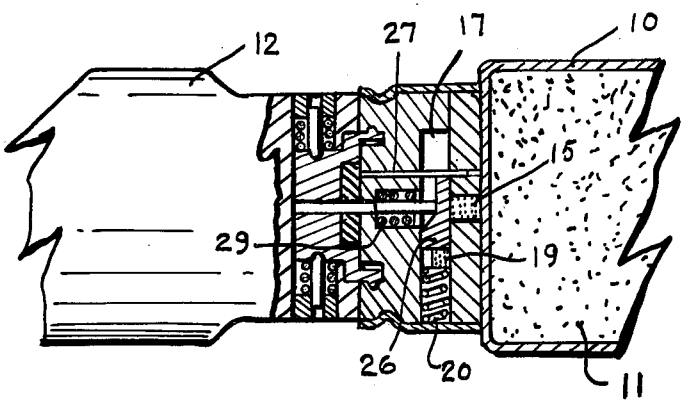
FIG. 3 is a sectional view of a second embodiment of the invention showing the apparatus arrangement during an initial stage of device operation.
Figure 4:
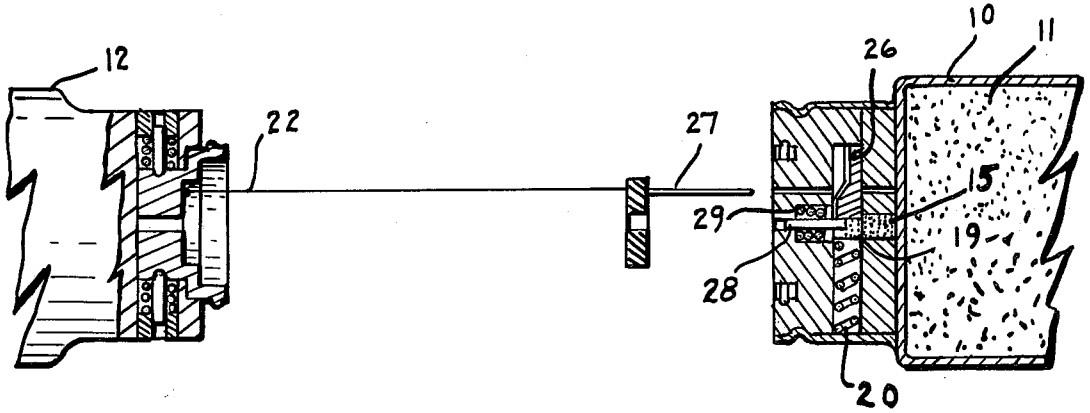
FIG. 4 is a sectional view of the embodiment of FIG. 3 showing the apparatus arrangement during a final stage of device operation.

With reference to FIGS. 3 and 4, a variation of the basic concept shown in FIGS. 1 and 2 is presented. The basic differences are as follows: The safety of the fuze is assured with a screw (not shown) that goes through the fuze end cap to rest on the end of the firing pin 28 which keeps the slider 26 in the safe position. In operation, the safety screw is removed before the round is placed in the magazine. Projection of the round, deployment of the lanyard 22, withdrawal of the safety pin 27 and slider action are the same. Firing pin action differs since this design uses a cammed firing pin in place of a lever type. Slider 26 has a ramp that drives the spring 29 loaded firing pin 28 into the firing position. As the detonator 19 comes in line with the booster 15, the firing pin reaches a step that allows the firing pin to drop off the cam surface and be springdriven by spring 29 into the detonator 19, causing detonation of the round.

The fuze comprehended by the present invention allows the safe loading and firing of a high explosive in an MHD-X generator. The design is simple and economical. The simplicity of the design assures a high degree of accuracy and reliability.

Figure 5:
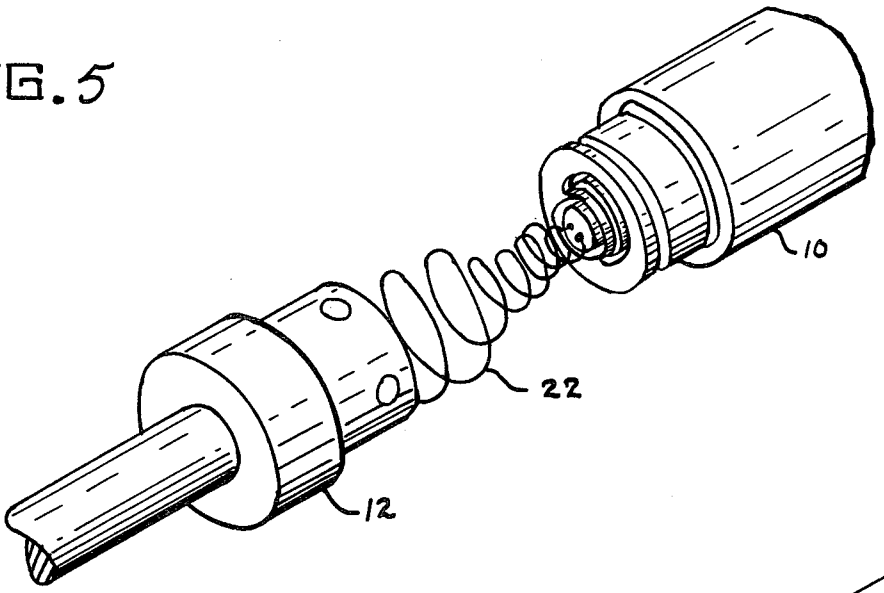
FIGS. 5 and 6 are orthogonal views of the embodiment of FIG. 3 illustrating intermediate and final stages respectively of device operations.
Figure 6:
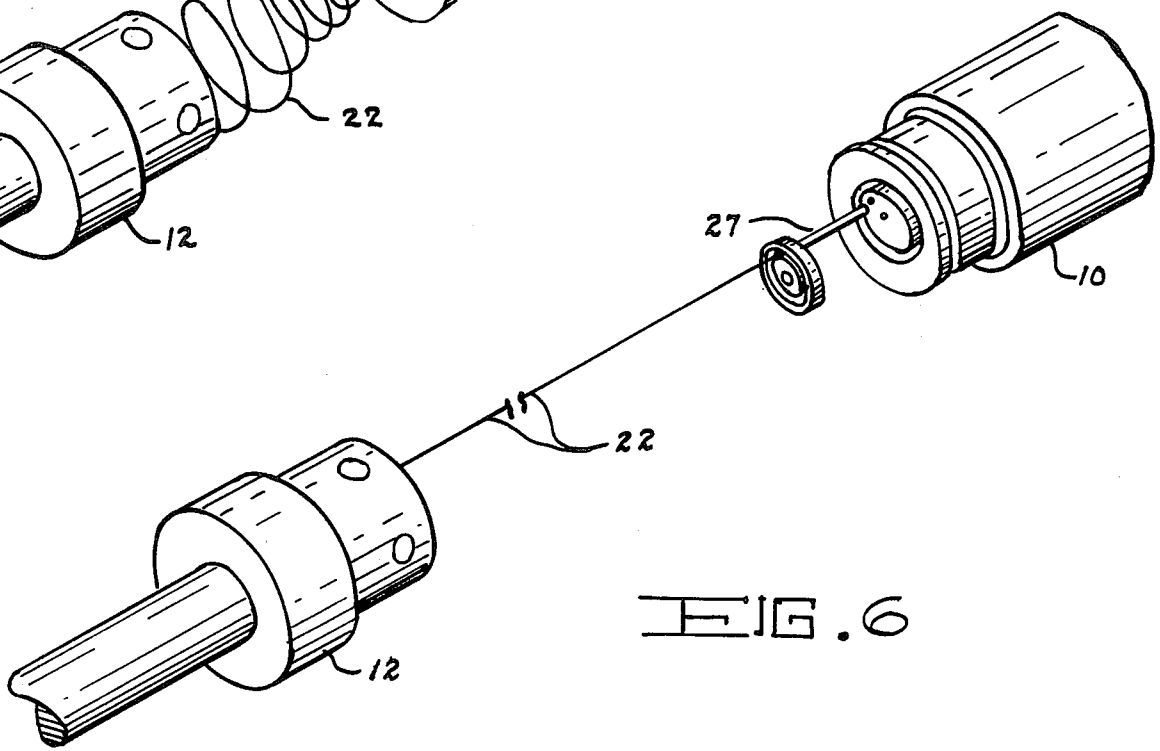

FIGS. 5 and 6 are isometric views of the deployment of a charge in the MHD-X. In FIG. 5 the charge has separated from the ram and the lanyard is uncoiling. In FIG. 6, the lanyard is fully extended, the safety pin has been pulled from the safe and arm device, and the charge is ready to detonate.

While the invention has been described in terms of its preferred embodiments, it is understood that the words which have been used are words of description rather that words of limitation and that changes within the purview of the appended claims may be made without departing from the scope and spirit of the invention in its broader aspects.

What is claimed is:

1. Apparatus for detonating an explosive charge at the center of an MHD generator comprising an explosive charge container, an explosive charge within said container, a booster explosive element mounted on said container in detonating communication with said explosive charge, a firing pin housing structure fixedly attached to said explosive charge container, said firing pin housing structure defining a channel transverse and adjacent to said booster explosive element, said channel having a closed end and an open end, a lever type firing pin pivotally mounted within said firing pin housing structure, a detonator element in said channel a spring in said channel interposed between said closed end of said channel and said detonator element, a slider member in said channel, said slider member having one end thereof abutting said detonator element and the other end thereof in alignment with said open end of said channel, said slider member having means thereon for rotating said firing pin into the detonating position, a safety pin member inserted to hold said slider member in an inoperative position within said channel, a release housing structure removably affixed to said firing pin housing structure said release housing structure having an extractor rim, a lanyard connected between said release housing structure and said safety pin member, a safety wire locking said release housing structure to said firing pin housing structure, and a reciprocating ram element, said ram element having a safety wire severing means and a mechanism for engaging the extractor rim of said release housing structure, said reciprocating ram element being adapted to sever said safety wire and engage and retain said release housing structure, firing pin housing structure and explosive charge container in a retracting action and retain said release housing structure and eject said firing pin housing structure and explosive charge container in a thrusting action whereby full extension of said lanyard removes said safety pin member to enable said spring to bias said detonator element into alignment with said booster explosive element and move said slider member through said open end of said channel into an operative position, said rotating means on said slider member thereby rotating said firing pin causing the subsequent detonation of said explosive charge.

2. Apparatus for detonating an explosive charge at the center of an MHD generator comprising an explosive charge container, an explosive charge within said container, a booster explosive element mounted on sad container in detonating communication with explosive charge contained therein, a firing pin housing structure fixedly attached to said explosive charge container, said firing pin housing structure defining a channel transverse and adjacent to said booster explosive element, a spring loaded firing pin in said firing pin housing structure aligned with said booster explosive element, a detonator element in said channel, a spring in said channel interposed between one end of said channel and said detonator element, a slider member in said channel, said slider member abutting against said detonator element and compressing said spring and retaining said detonator element out of register with said booster explosive element when in an inoperative position, said slider member having a cam shaped configuration adapted to cock and release said firing pin when released from its inoperative position, a safety pin member inserted to hold said slider member in an inoperative position, a release housing structure removably affixed to said firing pin housing structure said release housing structure having an extractor rim, a lanyard connected between said release housing structure and said safety pin member, and a reciprocating ram element, said ram element having a mechanism for engaging the extractor rim of said release housing structure, said reciprocating ram element being adapted to engage and retain the release housing structure, firing pin housing structure and explosive charge container in a retracting action and retain said release housing structure and eject said firing pin housing structure and explosive charge container in a thrusting action whereby full extension of said lanyard removes said safety pin member to enable said spring to bias said detonator element into alignment with said booster explosive element and move said slider member beyond said spring loaded firing pin into an operative position, the cam shaped configuration thereby cocking and releasing said firing pin causing the subsequent detonation of said explosive charge.

* * * * *